US005778688A

United States Patent [19]

Park et al.

[11] Patent Number: 5,778,688

[45] Date of Patent: Jul. 14, 1998

[54] TEMPERATURE CONTROLLING METHOD FOR SEPARATE COOLING REFRIGERATOR HAVING ROTARY BLADE

[75] Inventors: Hae-jin Park, Suwon; Hai-min Lee; Juong-ho Kim, both of Seoul; Soo-chul Shin, Kyungki-do; Jae-in Kim, Seoul; Yun-seok Kang, Suwon, all of Rep. of Korea

[73] Assignee: Samsung Electronics Co., Ltd., Kyungki-do, Rep. of Korea

[21] Appl. No.: 839,075

[22] Filed: Apr. 23, 1997

[30] Foreign Application Priority Data

Apr. 30, 1996 [KR] Rep. of Korea ..... 96-13970
Mar. 31, 1997 [KR] Rep. of Korea ..... 97-11844

[51] Int. Cl.[6] ..... F25D 17/08

[52] U.S. Cl. ..... 62/89; 62/186; 62/408; 62/180

[58] Field of Search ..... 62/180, 179, 186, 62/187, 89, 177, 407, 408, 404, 413, 414, 415; 236/49.3; 454/256, 258

[56] References Cited

U.S. PATENT DOCUMENTS

| | | | |
|---|---|---|---|
| 4,485,633 | 12/1984 | King et al. | 62/180 |
| 4,671,458 | 6/1987 | Fukuda et al. | 236/49.3 |
| 5,251,814 | 10/1993 | Warashina et al. | 62/186 X |
| 5,331,825 | 7/1994 | Kim | 62/180 |
| 5,355,686 | 10/1994 | Weiss | 62/180 X |
| 5,678,413 | 10/1997 | Jeong et al. | 62/186 X |
| 5,687,580 | 11/1997 | Jeong et al. | 62/408 X |
| 5,692,383 | 12/1997 | Jeong et al. | 62/89 |

FOREIGN PATENT DOCUMENTS

| | | |
|---|---|---|
| 06137738 | 5/1994 | European Pat. Off. . |
| 06300415 | 10/1994 | European Pat. Off. . |
| 07229668 | 8/1995 | European Pat. Off. . |
| 0 713 064 A1 | 5/1996 | European Pat. Off. . |
| 195 12 476 A1 | 10/1995 | Germany . |
| 2 201 014 | 8/1988 | United Kingdom . |
| WO 95/27238 | 10/1995 | WIPO . |

*Primary Examiner*—Harry B. Tanner
*Attorney, Agent, or Firm*—Burns, Doane, Swecker & Mathis, LLP

[57] ABSTRACT

A temperature controlling method is provided for a separate cooling refrigerator having a rotary blade in which a freezer compartment and a refrigeration compartment having the rotary blade at the rear wall thereof are separately cooled by installing an evaporator and a ventilation fan in each compartment, and a refrigerant is properly provided to each ventilation fan for the freezer and refrigeration compartments by a compressor. According to the method, a stationary angle of the rotary blade is controlled to discharge cool air into the highest-temperature portion within the refrigeration compartment, inferred by a fuzzy inference, and a cool air discharging cycle is also controlled by the compressor and the ventilation fan for the refrigeration compartment, maintaining the temperature equilibrium within the refrigeration compartment.

12 Claims, 7 Drawing Sheets

TEMPERATURE CONTROLLING METHOD FOR SEPARATE COOLING REFRIGERATOR HAVING ROTARY BLADE

BACKGROUND OF THE INVENTION

The present invention relates to a temperature controlling method for a separate cooling refrigerator having a rotary blade in which a refrigeration compartment having the rotary blade at the rear thereof and a freezer compartment are separately cooled by installing an evaporator and a ventilation fan in each compartment, respectively, to then simultaneously control a stationary angle of a rotary blade and a cool air discharging cycle in order to discharge cool air into the highest-temperature portion inferred by a fuzzy inference, thereby maintaining equilibrium in temperature within the refrigeration compartment.

As requirement for a large refrigerator increases, many methods and apparatuses for effectively cooling air in the refrigerator and reducing power consumption have been contrived. One of the apparatuses is a refrigerator adopting a separate cooling method (hereinafter referred to as "separate cooling refrigerator"), in which an evaporator and a ventilation fan are installed at the refrigeration compartment and the freezer compartment, respectively, to independently cool air in each compartment. As advantages of the separate cooling refrigerator, cool air can be intensively discharged into a compartment which requires much cool air by separately installing evaporator at each compartment, to which refrigerant is provided from a compressor. Here, the intensive cooling is effective when two evaporators are used compared to the case where only one evaporator is used. Also, since the evaporator is installed at each compartment, thermal loss and leakage of cool air due to long-distance transportation from the evaporator do not occur, energy loss can be prevented. Accordingly, power consumption is lowered.

However, the separate cooling refrigerator in which cool air is effectively distributed by two evaporators does not include a device for evenly maintaining temperature in the refrigeration compartment, so that temperatures at each portion within the refrigeration compartment are different according to the load of the items being refrigerated. Particularly, the problem pertinent to the load of the items being refrigerator is serious in a large refrigerator, so that it is difficult to evenly maintain temperature within the refrigeration compartment.

Thus, the highest-temperature portion within the refrigeration compartment should be intensively cooled, however, it is difficult to precisely measure temperatures at different portions in a general refrigerator adopting only two temperature sensors at the upper and lower portions of the refrigeration compartment.

SUMMARY OF THE INVENTION

It is an object of the present invention to provide a temperature controlling method for a separate cooling refrigerator having a rotary blade by which a cool air discharge direction is precisely controlled through inferring of the temperature distribution at each portion of a refrigeration compartment using a few of temperature sensors and a cool air discharging cycle is properly controlled, thereby intensively and periodically discharging cool air to the highest-temperature portion for the temperature equilibrium within the refrigeration compartment.

According to an aspect of the present invention, there is provided a temperature controlling method for a separate cooling refrigerator having a rotary blade in which a freezer compartment and a refrigeration compartment having the rotary blade at the rear thereof are separately cooled by installing an evaporator and a ventilation fan in each compartment, the method comprising the steps of: (a) comparing each temperature measured by a temperataure sensor for the freezer compartment and a temperature sensor for the refrigeration compartment to properly distribute cool air into the freezer compartment and the refrigeration compartment; (b) inferring a temperature equilibrium angle of the rotary blade required for discharging cool air into the highest-temperature portion among a predetermined number of portions within the refrigeration compartment whose temperatures are inferred; and (c) controlling a stationary angle of the rotary blade toward the inferred temperature equilibrium angle.

Here, preferably, the step (a) is performed by controlling the ratio of the operation time between the evaporator (F evaporator) and ventilation fan (F fan) for the freezer compartment and the evaporator (R evaporator) and ventilation fan (R fan) for the refrigeration compartment, with respect to a periodical operation time of a compressor, and the step (a) comprises the steps of: (a-1) starting the compressor, the R evaporator and the R fan; (a-2) starting the F evaporator and the F fan after a predetermined lapse of time from the step (a-1); (a-3) stopping the R evaporator and the R fan after a predetermined lapse of time from the step (a-2); and (a-4) stopping the F evaporator and the F fan after a predetermined lapse of time from the step (a-3), wherein the steps (a-1) through (a-4) are sequentially repeated to control the stop time of the R evaporator and the start time of the F evaporator, thereby controlling the amount of cool air to be discharged into the freezer compartment and the refrigeration compartment.

Also, preferably, the step (b) comprises the steps of: (b-1) making out data of temperature changing rate at a predetermined portions of the refrigeration compartment according to the lapse of time, based on the temperatures measured at each stationary angle of the rotary blade within the refrigeration compartment; (b-2) calculating a fuzzy model based on the data of temperature changing rate; and (b-3) performing a fuzzy inference according to the fuzzy model with the temperatures measured by temperature sensors attached to a predetermined portions of the walls of the refrigeration compartment to calculate the temperature equilibrium angle of the rotary blade for the temperature equilibrium within the refrigeration compartment. Here, the step (b-2) may comprise the steps of: (b-2-1) dividing the dat of temperataure changing rate according to a plurality of data area to calculate linear formulas for each data area; (b-2-2) calculating a value of unbiasedness criterion (UC) with respect to each linear formula; (b-2-3) comparing the values of UC to select the least value of UC; and (b-2-4) repeatedly performing the steps (b-2-1) through (b-2-3) with respect to the data area having the least value of UC to obtain a data-divided structure having the least value of UC and calculate a linear formula corresponding to a conclusion part of the fuzzy inference based on the data-divided structure having the least value of UC. Also, the step (b-2-2) may comprise the steps of: (b-2-2-1) calculating parameter values representing a fuzzy area of the data-divided structure; and (b-2-2-2) calculating the value of UC based on the parameter values. Also, preferably, the step (b-2-2-1) comprises the steps of: (b-2-2-1-1) determining the number of parameters of the fuzzy area forming the fuzzy structure; (b-2-2-1-2) fractionating the probabilistic temperature range of the refrigeration compartment by a predetermined number of bits to construct strings; (b-2-2-1-3) filling the bits of each string, the number of bits corresponding to the number of the parameters, and the remaining string of the string with different binary number to form a plurality of random strings; (b-2-2-1-4) calculating a correlation coefficient between the random strings and the measured temperatures; and (b-2-2-1-5) taking information of the random string having the greatest correlation coefficient as the value of parameter. In addition, the temperataure controlling method, after the step (b-2-2-1-5), may further comprise the steps of: reproducing the upper group corresponding to the upper 10% of random strings having great correlation coefficients, and selecting the lower group corresponding to the lower 10% of random strings having small correlation coefficients; crossing over the middle group other than the upper and lower groups with the upper group; and calculating a correlation coefficient of only a corrected upper group obtained by adding the random strings obtained by the crossover, having great correlation coefficients, to the upper group. Preferably, in the step (b2-4), a linear formula reflecting a weight of each fuzzy area in the data divided structure to the temperature equilibrium within the refrigeration compartment is calculated.

Preferably, in the step (c), the rotary blade is rotated at the equal velocity if the temperatures of the predetermined portions within the refrigeration compartment, inferred in the step (b), are in a predetermined error range.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
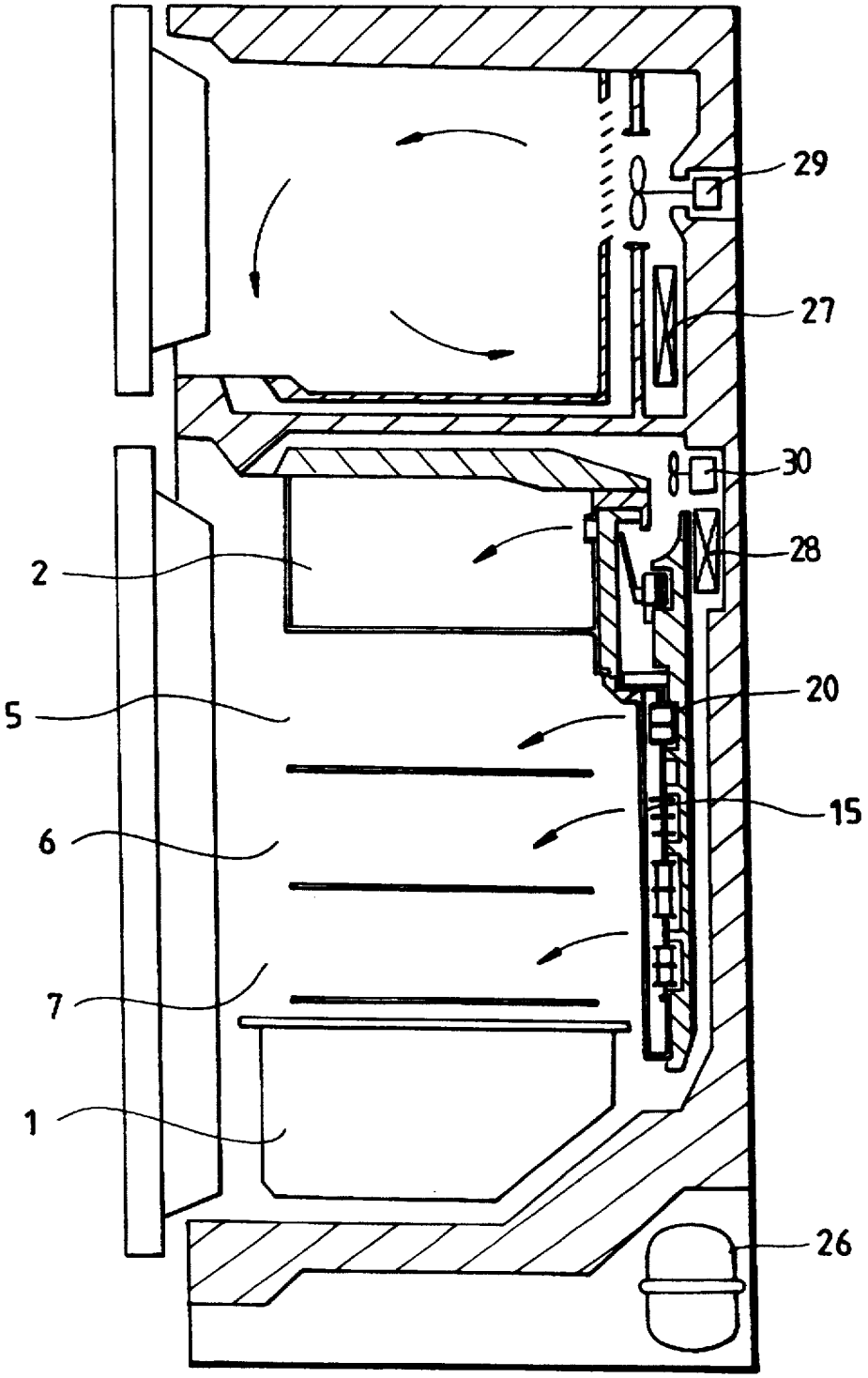
FIG. 1 is a side section view of a separate cooling refrigerator having a rotary blade, carrying out a temperature control method according to the present invention.

As shown in FIG. 1, a separate cooling refrigerator having a rotary blade includes a compressor 26, two evaporators 27 and 28 for generating cool air by receiving refrigerant provided from the compressor 26, and two ventilation fans 29 and 30. Generally, upper and lower portions of the refrigerator are used as a freezer compartment and a refrigeration compartment, respectively. In the freezer compartment, the cool air generated from the evaporator 27 (F evaporator) for the freezer compartment is provided thereto by the ventilation fan 29 (F fan) for the freezer compartment. Also, the cool air generated from the evaporator 28 (R evaporator for the refrigeration compartment is provided to the refrigeration compartment by the ventilation fan 18 (R fan) for the refrigeration compartment. A rotary blade 20 is installed at the rear wall of the refrigeration compartment, below the R fan 30. The cool air ventilated by the R fan 30 is provided into the refrigeration compartment through the rotary blade 20.

Figure 2:
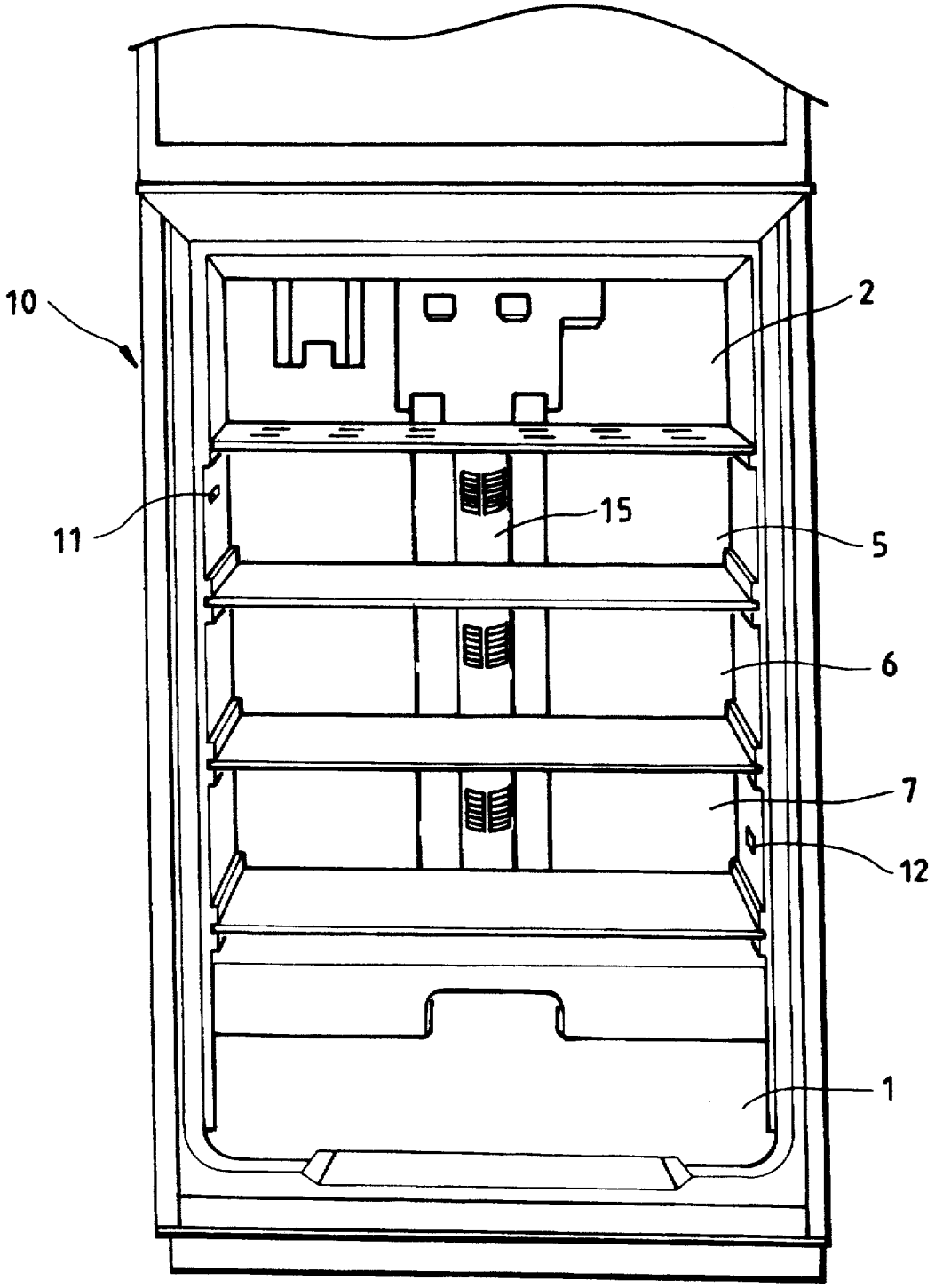
FIG. 2 is a perspective view showing the inside of the separate cooling refrigerator having the rotary blade shown in FIG. 1.

FIG. 2 is a perspective view showing the inside of the separate cooling refrigerator having the rotary blade.

The refrigeration compartment 10 is partitioned and the lowermost portion of the partitioned refrigeration compartment 10 is used as a crisper 1. Generally, the refrigeration compartment 10 exclusive of the crisper 1 is partitioned into four portions, wherein an uppermost portion 2 is generally called a fresh compartment. Here, the remaining portions will be called first, second and third portions 5, 6 and 7 from the top down. Also, considering that the height of the refrigeration compartment 10 is "H", the first, second and third portions 5, 6 and 7 are called 3H/4, 1H/2 and 1H/3 rooms, respectively. Two temperature sensors 11 and 22 are placed in the refrigerator compartment 10, wherein an S1 temperature sensor 11 for sensing the temperature of the upper left portion of the refrigeration compartment 10 is attached at the left wall of the first portion 5 (i.e., 3H/4 room) and an S2 temperature sensor 12 for sensing the temperature of the lower right portion of the refrigeration compartment 10 is attached at the right wall of the third portion 7 (i.e., 1H/3 room). In addition, a cool air discharging portion 15 is at the center of the rear wall of the refrigeration compartment 10. Here, the discharge of cool air from the cool air discharging portion 15 is controlled by the rotary blade 20.

Figure 3:
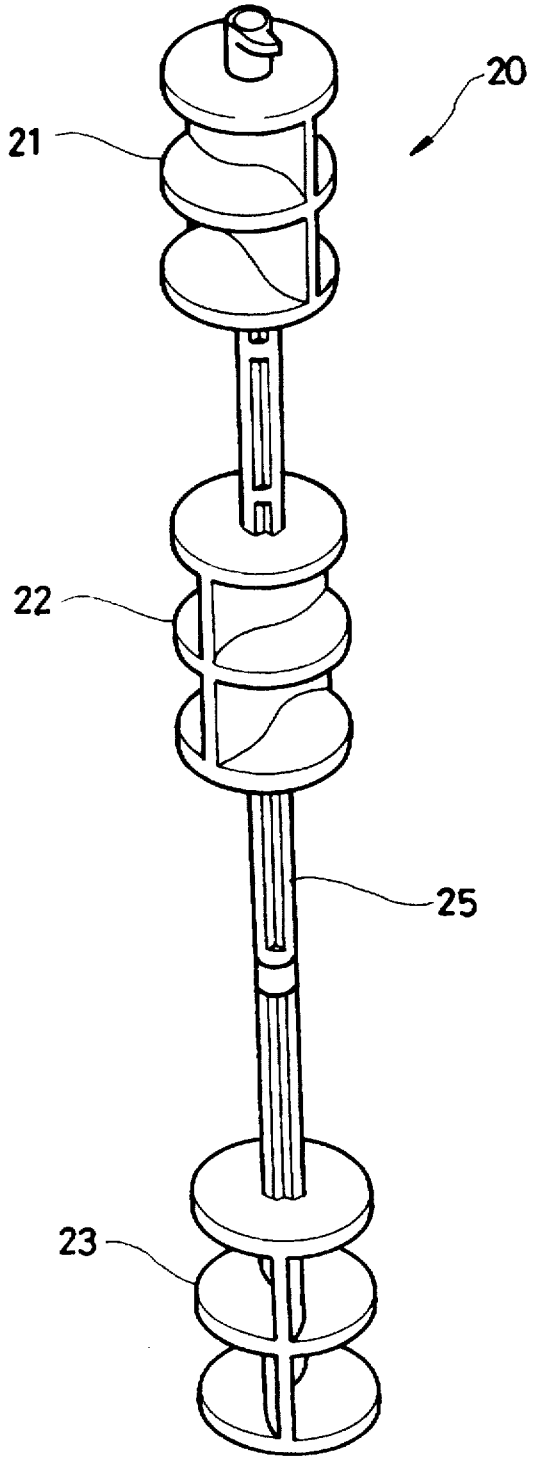
FIG. 3 is an enlarged perspective view of the rotary blade shown in FIG. 1.

FIG. 3 is an enlarged perspective view of the rotary blade.

Referring to FIG. 3, the rotary blade 20 is divided into an upper blade 21, a middle blade 22 and a lower blade 23, which locates corresponding to the first, second and third portions 5, 6 and 7. The upper, middle and lower blades 21, 22 and 23 rotate integrally centered around a rotary shaft 25. The upper, middle and lower blades 21, 22 and 23 are displaced from each other by 60°, directing air at different directions. The cool air discharging direction into the first, second and third portions 5, 6 and 7 are controlled according the stationary angle of the rotary blade 20.

The rotary blade 20 can ventilate the cool air while being pointed toward a predetermined direction to intensively discharge the cool air into a high-temperature portion, or evenly discharge the cool air into the refrigeration compartment 10 while rotating continuously.

Figure 4:
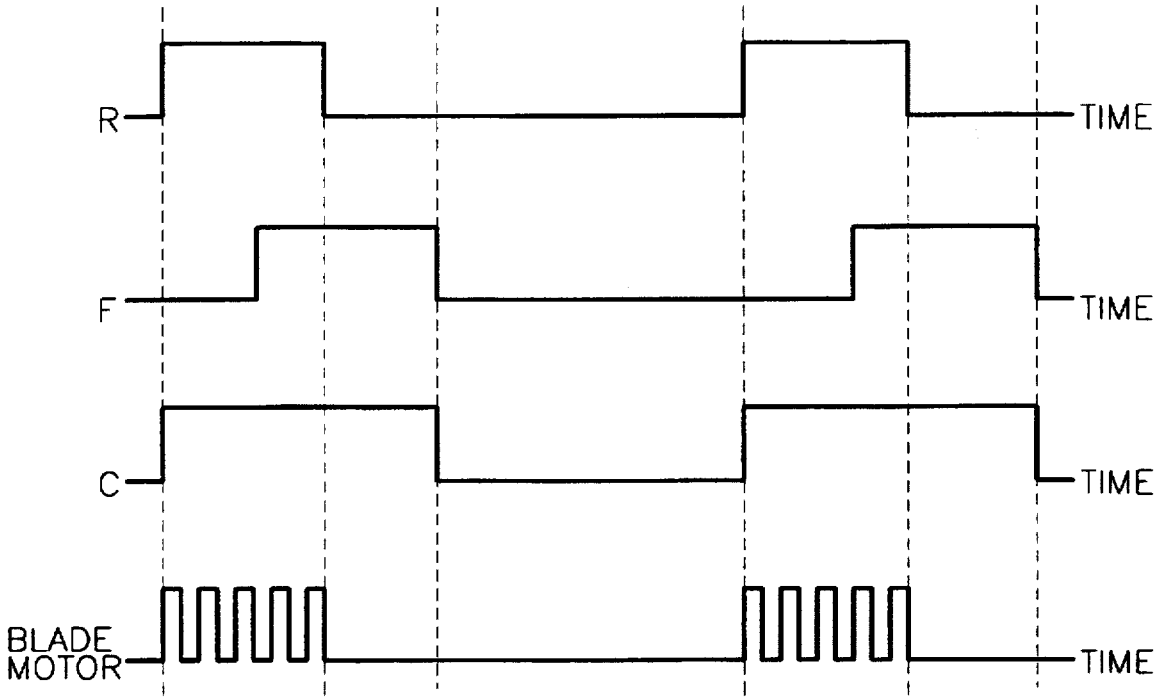
FIG. 4 is a graph showing the operation cycles of an R fan, an F fan and a compressor of the separate cooling refrigerator having the rotary blade shown in FIG. 1.

FIG. 4 is a graph showing the operation cycles of the R fan 30, F fan 29, compressor 26 and rotary blade 20 of the separate cooling refrigerator having the rotary blade. Here, "F" represents the operation cycle of the F fan, "C" represents that of the compressor, "R" represents that of the R fan and "BLADE MOTOR" represents that of the rotary blade driving motor for controlling the stop angle of the rotary blade 20, all of which operate at a high pulse.

When the operation of the refrigerator is started, the compressor 26 starts to operate and the operation of the R evaporator 28 and the R fan 30 are also started at the same time. After the lapse of a predetermined time, the F evaporator 27 and the F fan 29 start to operate and then the operation of the R evaporator 28 and the R fan 30 stop with a predetermined time interval from the operation of the F evaporator 27 and the F fan 29. Then, the operation of the compressor 26 stops and the operation of the F evaporator 27 and the F fan 29 stops at the same time. The compressor 26 repeats the start and stop of the operation with a predetermined cycle.

The amount of cool air discharged into the refrigeration compartment and the freezer compartment is controlled by controlling the operation stop time of the R evaporator 28 and the operation start time of the F evaporator 27. Thus, when a strong cooling is required, the operational sequence of the R evaporator 28 and the F evaporator 24 may be changed each other.

According to the present invention, the cool air distribution is evenly maintained within the refrigeration compartment of a separate cooling refrigerator in which intensity of cool air discharged into each compartment is effectively controlled. For the even cool air distribution, a stationary angle of the rotary blade, which is for discharging cool air into the highest-temperature portion of the refrigeration compartment, is inferred (hereinafter, the stationary angle required for discharging cool air toward the highest-temperature portion of the refrigeration compartment is referred to as "temperature equilibrium angle") and the stationary angle of the rotary blade is controlled toward the inferred temperature equilibrium angle, thereby evenly distributing cool air into the refrigeration compartment. Here, the inference to the temperature equilibrium angle should be performed on the assumption that only two temperature sensors S1 and S2 are used. For this end, a fuzzy model is constituted based on the real measured temperature values to calculate the temperature equilibrium angle of the rotary blade.

The temperature equilibrium angle of the rotary blade is calculated as follows based on the fuzzy mode.

First, change in temperatures of total six portions in the left and right of the first, second and third portions 5, 6 and 7 within the refrigeration compartment are measured according to the stationary angle of the rotary blade 20. Also, this temperature measurement is repeatedly performed with respect to a plurality of refrigerators. Then, the obtained data is expressed in a table to be used as a base data to the fuzzy inference. Here, the fuzzy inference is performed using the Takagi-Sugeno-Kang (TSK) fuzzy model, and the Genetic algorithm (GA) is also used for more precise inference during the fuzzy inference.

The temperature equilibrium angle of the rotary blade, for maintaining the temperature equilibrium, is inferred by the fuzzy inference as follows.

The inference target portions within the refrigeration compartment 10 are set as six including t1, t2, t3, t4, t5 and t6, wherein t1 and t2 corresponds to the left and right of the first portion (3H/4 room), t3 and t4 corresponds to the left and right of the second portion (1H/2 room), and t5 and t6 corresponds to the left and right of the third portion (1H/3 room). In order to prepare base data for applying the fuzzy inference, temperature sensors are set at six portions (t1 through t6) to measure change in temperatures therein. That is, after conditioning the refrigeration compartment 10 to a suitable temperature for the refrigeration, a reference angle of the rotary blade is set based on a specific blade constituting the rotary blade in consideration of different stationary angles at each room. Here, the upper blade 21 is selected as the base blade. Also, a reference direction of the rotary blade for measuring the stationary angle may different by selection, however, the stationary angle is set here as 0° when the upper blade 21 of the rotary blade discharges cool air toward the leftmost portion of the refrigeration compartment 10. Thus, when the upper blade 21 of the rotary blade discharges cool air toward the rightmost portion thereof, the stationary angle of the rotary blade becomes 180°. While the rotary blade 20 is pointed toward the portion having the stationary angle of 0°, temperatures at six portions are measured with a predetermined time interval, and then temperataure descending rate at each portion is calculated to be used as a data for the position having the stationary angle of 0°. By changing the stationary angle of the rotary blade to 180° by 10°, temperature descending rate at each portion is calculated in the same manner as the above, and then the result is recorded in Table 1. Here, since the cool air discharging direction of the rotary blade may be different by each blade constituting the rotary blade and the inner structure of the refrigeration compartment 10 are different at each portion, the temperature descending rate is different from each portion.

TABLE 1

| | t1 | t2 | t3 | t4 | t5 | t6 |
|---|---|---|---|---|---|---|
| 10° | 0.104 | 0.120 | 0.057 | 0.058 | 0.085 | 0.082 |
| 20° | 0.099 | 0.120 | 0.061 | 0.065 | 0.067 | 0.086 |
| 30° | 0.099 | 0.115 | 0.058 | 0.060 | 0.066 | 0.091 |
| 40° | 0.102 | 0.115 | 0.058 | 0.060 | 0.066 | 0.091 |
| 50° | 0.119 | 0.116 | 0.062 | 0.058 | 0.070 | 0.088 |
| 60° | 0.169 | 0.197 | 0.178 | 0.017 | 0.130 | 0.177 |
| 70° | 0.146 | 0.173 | 0.122 | 0.110 | 0.105 | 0.185 |
| 80° | 0.128 | 0.142 | 0.074 | 0.088 | 0.075 | 0.121 |
| 90° | 0.097 | 0.120 | 0.057 | 0.065 | 0.063 | 0.064 |
| 100° | 0.114 | 0.135 | 0.082 | 0.068 | 0.122 | 0.065 |
| 110° | 0.115 | 0.129 | 0.071 | 0.065 | 0.109 | 0.066 |
| 120° | 0.118 | 0.120 | 0.073 | 0.063 | 0.116 | 0.070 |
| 130° | 0.117 | 0.111 | 0.068 | 0.058 | 0.121 | 0.070 |
| 140° | 0.116 | 0.103 | 0.063 | 0.081 | 0.137 | 0.072 |
| 150° | 0.107 | 0.097 | 0.051 | 0.073 | 0.104 | 0.072 |
| 160° | 0.106 | 0.087 | 0.053 | 0.050 | 0.113 | 0.066 |
| 170° | 0.093 | 0.091 | 0.047 | 0.041 | 0.079 | 0.073 |
| 180° | 0.090 | 0.098 | 0.051 | 0.047 | 0.064 | 0.069 |

A false temperature distribution is obtained using several hundred of data as shown in Table 1, the optimum stationary angle of the rotary blade is calculated from the false temperature distribution.

The optimum stationary angle of the rotary blade 20 (i.e., "temperature equilibrium angle") for the temperature equilibrium within the refrigeration compartment is inferred using input variables of t1, t2, t3, t4, t5 and t6 and an output variable of "ang", wherein t1 and t2 represent temperatures at the left and right of the 3H/4 room, t3 and t4 represent temperatures at the left and right of the 1H/2 room, and t4 represent temperatures at the left and right of the 1H/3 room, and "ang" as the output variable represents the temperature equilibrium angle.

Hereinafter, the fuzzy inference step for calculating the temperature equilibrium angle will be described by stage.

STAGE 1

By repeating the above temperature measurement, 500 sets of data like that shown in Table 1 are obtained to construct the TSK fuzzy model. First, a linear formula corresponding to the conclusion part of the TSK fuzzy inference is obtained from the whole data using the minimum square method which is generally used for the numerical analysis, resulting in the following formula (1). Here, the number of input variables is minimized using the variable decreasing method based on an error rate.

$$ang=10.15+0.65t1-0.7t2-0.83t3+0.53t4+0.9t5-0.49t6 \quad (1)$$

Then, the unbiasedness criterion (UC) is applied to the formula (1), wherein the UC is generally used in the group method of data handling (GMDH) which is for modeling the relationship between input and output variables in a nonlinear system into a polynomial expression.

To obtain the value of UC, the input data is divided into two groups A and B. Here, the degree in data scattering is controlled to be nearly the same between the groups. For example, the group A should not include many data having small value of t1 and adversely the group B should not include many data having great value of t1. Then, the data is substituted for the variables of the following formula (2) to obtain the value of UC.

$$UC=\left[\sum_{i=1}^{n_A}(y_i^{AB}-y_i^{AA})^2+\sum_{i=1}^{n_B}(y_i^{BA}-y_i^{BB})^2\right]^{\frac{1}{2}} \quad (2)$$

where $n_A$ represents the number of data in group A, $n_B$ represents the number of data in group B, $Y_i^{AA}$ represents an output estimated from group A by the fuzzy model which is obtained by group A, $Y_i^{AB}$ represents an output estimated from group A by the fuzzy model which is obtained by group B, $Y_i^{BB}$ represents an output estimated from group B by the fuzzy model which is obtained by group B, $Y_i^{BA}$ represents an output estimated from group B by the fuzzy model which is obtained by group A, the first term represents the difference between the estimated outputs between the groups A and B with respect to the input data of the group A, and the second term represents the difference between the estimated outputs between the groups A and B with respect to the intput data of the group B.

The value of UC obtained from the above is called $UC_{(1)}$ and the calculated $UC_{(1)}$ is 2.16. The process for selecting the fuzzy division structure whose UC value becomes minimum is proceeded as follows.

STAGE 2

A fuzzy model accompanying two plant rules is established. Here, in the establishment of the structure of a precondition part, the selection of variables and fuzzy division are considered simultaneously.

First, a structure having one of variables t1, t2, t3, t4, t5, t6 and t7 as a variable of the precondition part is premised and the data area is divided into two. Thus, the following six structures are considered for the precondition part. That is, the fuzzy state of the variables t1–t6 of the precondition part is divided into a low temperature state ("SMALL") and a high temperature state ("BIG"), and fuzzy functions representing the degree of SMALL and BIG are obtained. Prior to the description of the steps of obtaining parameters required for the fuzzy functions and obtaining the temperature equilibrium angle, six structures of the precondition part are shown as below together with the results thereof.

First Structure

L1: IF t1=SMALL THEN
ang=9.32+0.96t1−0.44t2−0.7t3+0.61t4+1.13t5−0.62t6

L2: IF t1=BIG THEN
ang=7.06+1.88t1−1.11t2−0.97t3+0.45t4+0.56t5−0.36t6

Second Structure

L1: IF t2=SMALL THEN
ang=6.56+2.14t1−9.39t2−2.2t3−0.32t4−0.89t5−1.04t6

L2: IF t2=BIG THEN
ang=1.03+0.49t1−0.94t2−0.72t3+0.6t4+1.08t5−0.44t6

Third Structure

L1: IF t3=SMALL THEN
ang=10.26+0.71t1−1.34t2−1.06t3+0.44t4+0.8t5−0.21t6

L2: IF t3=BIG THEN
ang=10.93+0.58t1−0.23t2−1.26t3+0.55t4+0.98t5−0.64t6

Fourth Structure

L1: IF t4=SMALL THEN
ang=10.38+0.68t1−0.82t2−0.84t3+0.5t4+1.06t5−0.63t6

L2: IF t4=BIG THEN
ang=7.5+0.652t1−0.631t2−0.8t3+1.38t4+0.77t5−0.4t6

Fifth Structure

L1: IF t5=SMALL THEN
ang=1.08+0.78t1−0.84t2−0.87t3+0.7t4+0.79t5−0.59t6

L2: IF t5=BIG THEN
ang=4.41−0.26t1−0.03t2−0.49t3−0.62t4+2.99t5−0.11t6

Sixth Structure

L1: IF t6=SMALL THEN
ang=8.64+0.49t1−0.8t2−0.52t3+0.34t4+0.63t5−3.01t6

L2: IF t6=BIG THEN
ang=1.51+0.79t1−0.7t2−1.02t3+0.67t4+1.1t5−2.23t6

Then, each UC is obtained from the output variables to the above six structures. Here, for obtaining the UCs, fuzzy division area (parameter of the precondition part) with respect to each structure should be found, wherein the genetic algorithm (GA) instead of a general complex method is applied to establish the parameters of the precondition part.

Figure 5:
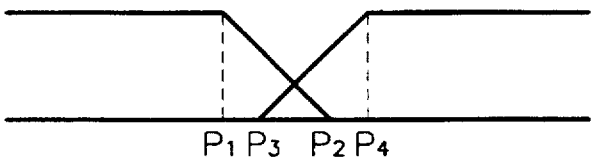
FIG. 5 is a graph showing the parameters of the precondition part in the first structure of two-divided structure.

For example, the parameters of the precondition part corresponding to the first structure (hereinafter, referred to as (2-1) structure) are shown in FIG. 5.

Here, P1 and P2 represent the lower and upper limits in the range corresponding to the SMALL, and P3 and P4 represent the lower and upper limits in the range corresponding to the BIG. Thus, the structure of the fuzzy function is determined by four parameters P1, P3, P2 and P4.

It is assumed that the temperature of the refrigeration compartment is controlled in the range from −10° C. to 20° C., which is reasonable temperature range within the refrigeration compartment. The temperature range is fractionated by 0.1° C. to construct strings each having 300 bits. Arbitrary four bits among 300 bits of each string are filled with "1" and the remaining bits are filled with "0" to form a random string. Here, several hundred of random strings are constructed.

Then, the GA is applied to the process of the fuzzy inferrence using the random strings and the measured values of Table 1. First, correlation coefficients between each random string and the measured values are obtained, and then the upper 10% of random strings having great correlation coefficients, the lower 10% of random strings having small correlation coefficients, and the remaining random strings are classified as upper, lower and middle groups, respectively.

The upper group is reproduced and the lower group is selected. Also, the middle group generates new random strings through the crossover with the upper group. Then, correlation coefficients are obtained from the newly generated random strings, and then reproduction, selection and crossover are repeated. The correlation coefficients of the repeatedly generated random strings are continuously compared each other until greater coefficient than the currently compared coefficient does not exist. If greater multiple coefficient than the currently compared coefficient does not exist, data of the corresponding random string is determined as the parameters of the precondition part, corresponding to P1, P2, P3 and P4.

After the parameters of the precondition part are determined, the value of UC is obtained according to the parameters. Here, the obtained value of UC is for the (2-1) structure, which is expressed as $UC_{(2-1)}$.

The values of UC with respect to the second to sixth structures (hereinafter, referred to as (2-2) to (2-6) structures) are obtained by the same method, and then all values of UC are compared as follows.

$$UC_{(2-2)}(2.119)<UC_{(2-3)}(2.157)<UC_{(1)}(2.16)<UC_{(2-1)}(2.202)<UC_{(2-5)}(2.215)<UC_{(2-6)}(2.223)<UC_{(2-4)}(2.235)$$

wherein assuming that the value of UC with respect to each structure is expressed as $UC_{(x-y)}(z)$, x represents the number of divided data area, y represents each structure, and z represented calculated value of UC, respectively. For example, $UC_{(2-6)}(2.223)$ means that the UC value of the sixth structure of the two-divided data area is equal to 2.223.

As shown in the above comparison, the least value of UC is with respect to the second structure in the two-divided data area. Accordingly, a new three-divided structure is made based on the two-divided structure with respect to the variable t2.

STAGE 3

In order to construct three-divided structure, a data area of t2–t1 should be made by adding a new variable. Here, the variables t1, t3, t4, t5 and t6 may be taken as the ti, so that many structures may be made. Thus, in order to eliminate unnecessary structure, the variables having the value of UC which is larger than $UC_{(1)}$ are omitted. Accordingly, t2–t3 data area is fuzzy-divided into three in the current system. Here, the obtained structures are shown in FIGS. 6A to 6C.

Figure 6A:
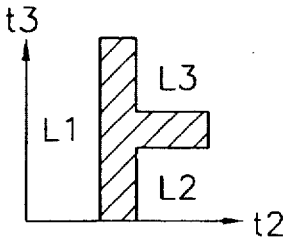
FIGS. 6A, 6B and 6C are graphs showing the divided structure when the data is fuzzy-divided into three.
Figure 6B:
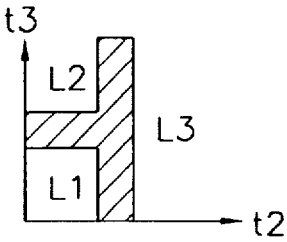
Figure 6C:
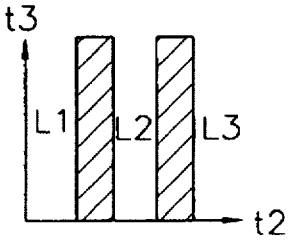

FIGS. 6A to 6C are graphs each showing the divided structure when the data shown in Table 1 is fuzzy-divided into three. Here, the variables t2 and t3 are designated as the horizontal and vertical axes, respectively. Since the fuzzy division is performed based on the variable t2, the fuzzy division can be performed by three methods.

In FIG. 6A, the data area is divided into three including area L1(t2=SMALL), area L2(t2=BIG and t3=SMALL) and area L3(t2=BIG and t3=BIG). The fuzzy function according to the fuzzy division and the output variable "ang" of the function, representing the first structure of the three-divided structure (hereinafter, referred to as (3-1) structure), are shown as follows. As the above STAGE 2, parameters, fuzzy functions by the parameters and the temperataure equilibrium angle are shown together with each fuzzy structure, which is applied to the description of the following STAGE.

First Structure

L1: IF t2=SMALL THEN ang=8.22+1.31t1−5.39t2−1.3t3+0.15t4+0.09t5−0.74t6

L2: IF t2=BIG and t3=SMALL THEN ang=9.87+0.59t1−1.59t2−1.84t3+0.69t4+1.06t5−0.15t6

L3: IF t2=BIG and t3=BIG THEN ang=11.73+0.42t1−0.59t2−1.28t3+0.55t4+1.12t5−0.57t6

In FIG. 6B, the fuzzy division is performed into three including area L1 (t2=SMALL and t3=SMALL), area L2 (t2=SMALL and t3=BIG) and area L3(t2=BIG). The fuzzy function according to the fuzzy division and the output variable "ang" of the function, representing the second structure of the three-divided structure (hereinafter, referred to as (3-2) structure), are shown as follows.

Second Structure (2) L1: IF t2=SMALL and t3=SMALL THEN ang=7.04+1.41t1−10.13t2+0.59t3−1.0t4−0.51t5−0.68t6

L2: IF t2=SMALL and t3=BIG THEN ang=11.87+1.82t1−4.32t2−3.4t3+0.75t4−0.28t5−1.34t6

L3: IF t2=BIG THEN ang=10.28+0.49t1−0.93t2−0.72t3+0.59t4+1.08t5−0.44t6

In FIG. 6C, the fuzzy division is performed into three including area L1 (t2=SMALL), area L2 (t2=MEDIUM) and area L3 (t2=BIG). The fuzzy function according to the fuzzy division and the output variable "ang" of the function, representing the third structure of the three-divided structure (hereinafter, referred as to (3-3) structure), are shown as follows.

Third Structure

L1: IF t2=SMALL THEN ang=9.13+1.28t1−4.65t2−1.44t3+0.14t4+0.02t5−0.71t6

L2: IF t2=MEDIUM THEN ang=9.99+0.52t1−0.61t2−0.87t3+0.6t4+1.17t5−0.51t6

L3: IF t2=BIG THEN ang=11.84+0.27t1−1.54t2+0.13t3+0.46t4+0.45t5−0.06t6

Figure 7:
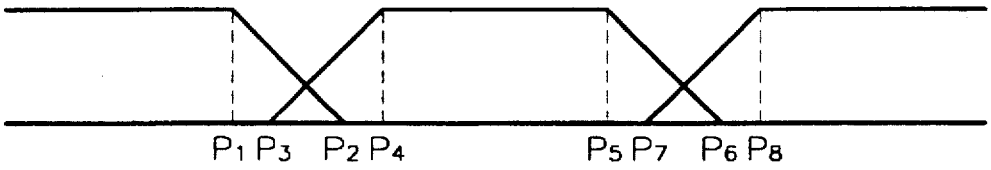
FIG. 7 is a graph showing the parameters of the precondition part in the third structure of three-divided structure.
Figure 8A:
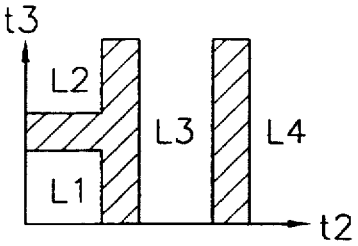
FIGS. 8A through 8D are graphs each showing the divided structure when the data is fuzzy-divided into four.
Figure 8B:
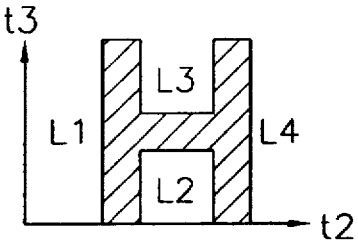
Figure 8C:
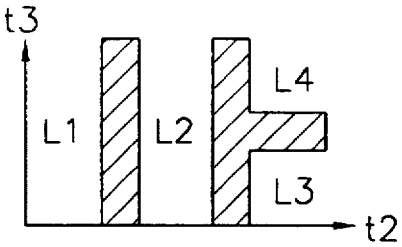
Figure 8D:
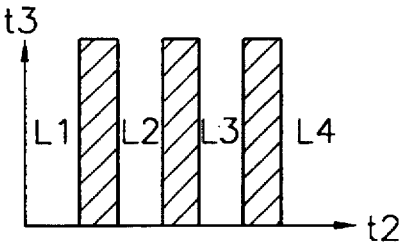

Among the fuzzy division area, the fuzzy division area shown in FIG. 6C, that is, the (3-3) structure, has the parameters for the precondition part shown in FIG. 7. The above parameters are obtained using the GA as the STAGE 2.

As in the STAGE 2, it is assumed that the temperature of the refrigeration compartment is controlled in the range from −10° C. to 20° C., which is reasonable temperature range within the refrigeration compartment. The temperature range is fractionated by 0.1° C. to construct strings each having 300 bits. Arbitrary eight bits among 300 bits of each string are filled with "1" and the remaining bits are filled with "0" to form a random string. Here, several hundred of random strings are constructed.

Then, the GA is applied using the random strings and the measured values of Table 1. First, correlation coefficients between each random string and the measured values are obtained, and then the upper 10% of random strings having great correlation coefficients, the lower 10% of random strings having small correlation coefficients, and the remaining random strings are classified as upper, lower and middle groups, respectively. The upper group is reproduced and the lower group is selected. Also, the middle group generates new random strings through the crossover with the upper group. Then, correlation coefficients are obtained from the newly generated random strings, and then reproduction, selection and crossover are repeated. The correlation coefficients of the repeatedly generated random strings are continuously compared each other until greater coefficient than the currently compared coefficient does not exist. If greater coefficient than the currently compared coefficient does not exist, data of the corresponding random string is determined as the parameters of the precondition part, corresponding to P1, P2, P3, P4, P5, P6, P7 and P8.

After the parameters of the precondition part are determined, the value of UC is obtained according to the parameters. Here, the obtained UC value is for the (3-3) structure shown in FIG. 6C.

The UC values with respect to the (3-1) and (3-2) structures are obtained by the same method, and then all UC values are compared to select the structure having the least UC value. Then, the data area of the selected structure is divided into four to obtain four fuzzy rules. Here, the fuzzy division into four is performed when $UC_{(3-1)}$, $UC_{(3-2)}$ and $UC_{(3-3)}$ are less than $UC_{(2-2)}$. On the contrary, if those are larger than $UC_{(2-2)}$, the fuzzy rule having the $UC_{(2-2)}$ is determined as a final without the fuzzy division into four. The comparison in the UC values obtained in the current system is as follows.

$$UC_{(3-3)}(1.92)<UC_{(3-1)}(1.97)<UC_{(3-2)}(1.98)<UC_{(2-2)}(2.119)$$

As shown in the above comparison, the (3-3) structure has the least UC value. Thus, a new four-divided structure is constructed based on the (3-3) structure.

STAGE 4

In this stage, the structure of the precondition part of the fuzzy model in the STAGE 3 is further fractionated to establish a fuzzy model accompanying four plant rules. Here, if any structure having the UC value which is less than $UC_{(2-2)}$ exists in STAGE 3, the corresponding structure is considered as a start structure for the fuzzy division into four. However, in order to omit a search process, the (3-3) structure of STAGE 3 having the least UC value is selected as a base structure for the fuzzy division into four.

FIGS. 8A through 8D are graphs each showing the divided structure when the data shown in Table 1 is fuzzy-divided into four, wherein the variables t2 and t3 are designated as the horizontal and vertical axes, respectively. There are four method for the fuzzy division based on the (3-3) structure.

The UC values with respect to the above four fuzzy division structures (hereinafter, referred to as (4-1) to (4-4) structures) are obtained by the same method in STAGE 3. Each UC value is compared as follows.

$$UC_{(4-1)}(1.871)<UC_{(4-2)}(1.904)<UC_{(4-3)}(1.906)<UC_{(4-4)}(1.912)<UC_{(3-3)}(1.92)$$

Since the UC value with respect to the (4-1) structure is the least, the five-fuzzy division is performed based on the (4-1) structure having the least UC value. However, all UC values of the structures obtained from the five-fuzzy division are larger than $UC_{(4-1)}$.

Accordingly, the temperature equilibrium angle of the rotary blade for the optimum temperature equilibrium within the refrigeration compartment has the first structure of the four-fuzzy division (i.e., (4-1) structure) for the precondition part.

Finally, the final structure of the precondition part, parameters and structure of the conclusion part, obtained based on the first structure of the four-fuzzy division, are as follows.

L1: IF t2=SMALL and t3=SMALL THEN ang1=10.56+1.27t1−3.5t2−0.1t3−0.26t4+0.16t5−0.92t6

L2: IF t2=SMALL and t3=BIG THEN ang2=−5.84+0.87t1+9.07t2+1.47t3+3.02t4+1.64t5+0.66t6

L3: IF t2=MEDIUM THEN ang3=10.25+0.48t1−0.64t2−0.95t3+0.58t4+1.17t5−0.52t6

L4: IF t2=BIG THEN ang4=8.63+0.27t1−0.61t2+0.24t3+0.56t4+0.3t5−0.34t6

Figure 9:
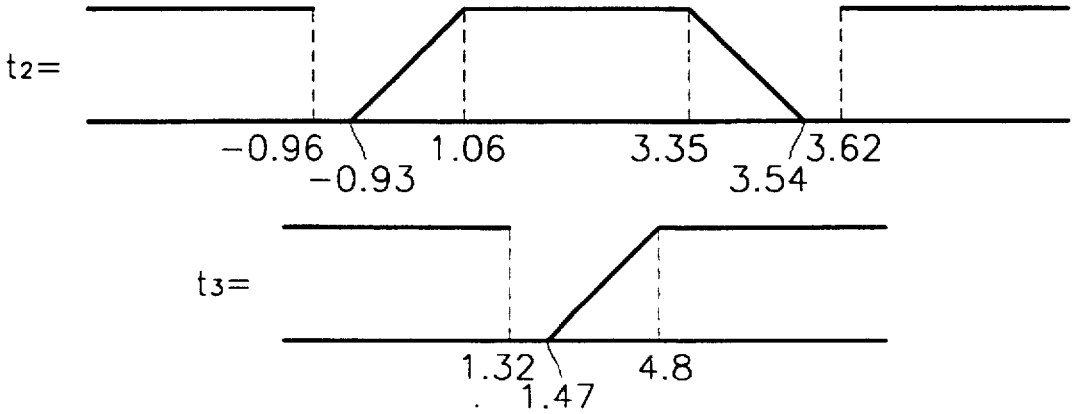
FIG. 9 is a graph showing the parameters of the precondition part in the first structure of four-divided structure.

The parameters of the precondition part are shown in FIG. 9, which are obtained by applying the GA as in the STAGES 2 and 3.

The final temperature equilibrium angle ang(k+1) of the rotary blade is calculated from the above fuzzy model using the following formulas (3) and (4).

$$W1=\min\{1, \max\{0,(1.06-t2)/(-0.96)\}\}$$

$$W2=\min\{1, \max\{0,(4.86-t3)/1.32)\}\}$$

$$W3=\min\{1, \max\{0,(4.8-t3)/1.47)\}\}$$

$$W4=\min\{1, \max\{0,(3.54-t2)/3.35\}\}$$

$$W5=\min\{1, \max\{0,(1.06-t2)/(-0.93)\}\}$$

$$W6=\min\{1, \max\{0,(3.62-t2)/3.35\}\} \quad (3)$$

In the above formula (3), W1, W2, W3, W4, W5 and W6 represent weights, for reflecting the degree in the contribution of the input variables of each data area in the finally determined (4-1) structure to the fuzzy function, which is obtained according to a general theory of the TSK fuzzy inference.

Finally, the final temperature equilibrium angle ang(k+1) is calculated using W1, W2, W3, W4, W5 and W6, and ang1, ang2, ang3 and ang4 as the following formula (4).

$$ang(k+1)=W1W2\,ang1+W1(1-W3)ang2+W4(1-W5)ang3+(1-W2)ang4 \quad (4)$$

Figure 10:
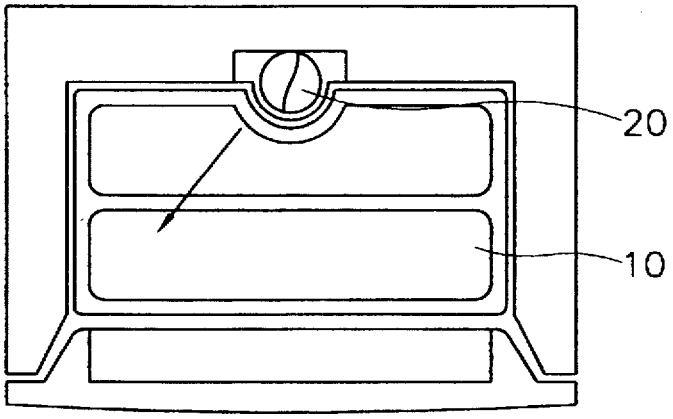
FIG. 10 is a schematic cross-section view illustrating the state where cool air is discharged into the left of a refrigeration compartment of the separate cooling refrigerator having the rotary blade shown in FIG. 1.

The stationary angle of the rotary blade 20 is controlled according to the calculated temperature equilibrium angle ang(k+1) as shown in FIG. 10 in which the cool air is discharged into the left of the refrigeration compartment. That is, the cool air is discharged into the highest-temperature position, thereby evenly maintaining temperature within the refrigeration compartment.

Figure 11:
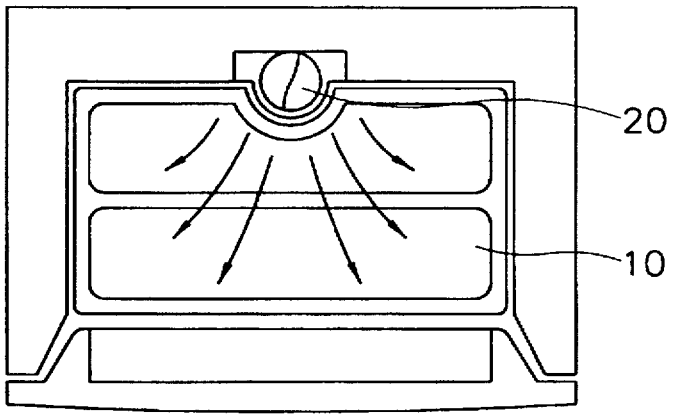
FIG. 11 is a schematic cross-section view illustrating the state where cool air is evenly discharged into a refrigeration compartment by the rotation of the rotary blade in the refrigerator shown in FIG. 1.

FIG. 11 is a schematic sectional view showing the state where the cool air is evenly discharged into the refrigeration compartment by the rotation of the rotary blade. When temperatures at each position of the refrigeration compartment are maintained within a predetermined of error range, the rotary blade 20 continuously rotates at a predetermined velocity to maintain the equilibrium in the temperature distribution.

Figure 12:
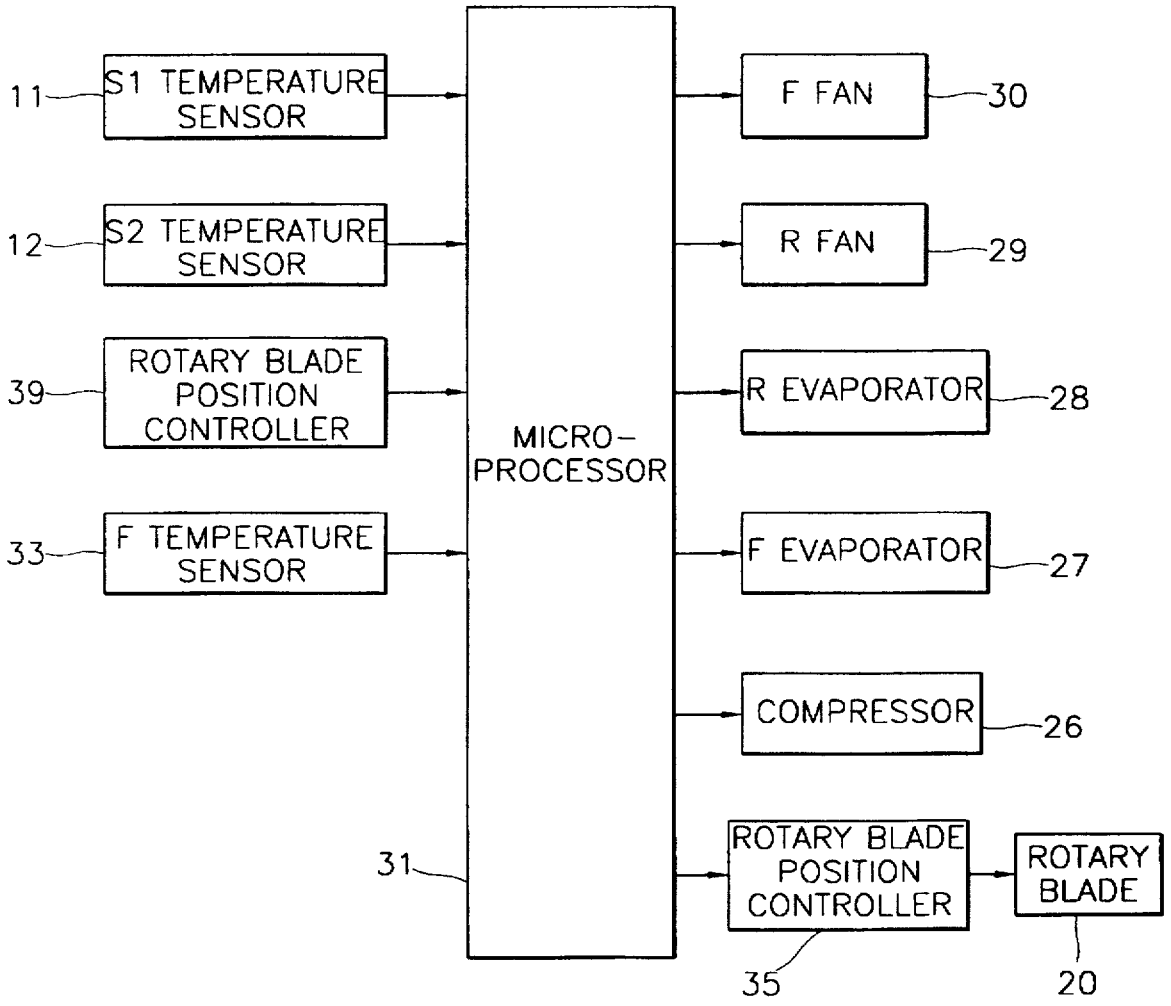
FIG. 12 is a block diagram illustrating the temperature control system of the separate cooling refrigerator having the rotary blade shown in FIG. 1.

FIG. 12 is a block diagram illustrating the temperature controlling method according to the present invention. The overall control is performed by a microprocessor 31. The microprocessor 31 includes a fuzzy inference portion (not shown) in which the fuzzy inference for the temperature equilibrium within the refrigeration compartment is performed based on the temperatures measured by S1 and S2 temperature sensors 11 and 12, and then the obtained temperature data are provided to a rotary blade position controller 35. An F temperature sensor 33 is for sensing temperature within the freezer compartment. The amount of cool air to be discharged into the freezer compartment and the refrigeration compartment for the separate cooling is determined by using the F temperature sensor 33, and the S1 and S2 temperature sensors 11 and 12. Also, the R fan 30, R evaporator 28, F fan 29 and F evaporator 27 are controlled according to the determined amount of cool air to be discharged into each compartment.

The result obtained from the calculation by the fuzzy inference position of the microprocessor 31 is provided to the rotary blade position controller 35, and the rotary blade position controller 35 controls the stationary angle of the rotary blade to the temperature equilibrium angle or rotates the rotary blade 20 at a predetermined velocity. A rotary blade position sensor 39 senses the real stationary angle of the rotary blade and provides the result to the microprocessor 31, and the microprocessor 31 compares the real stationary angle with the temperature equilibrium angle to correct error therebetween, thereby much precisely controlling the stationary angle of the rotary blade.

According to the temperature controlling method for the separate cooling refrigerator having a rotary blade in which the refrigeration compartment and the freezer compartment are separately cooled by installing an evaporator and a ventilation fan in each compartment, respectively, and a refrigerant is provided into the F evaporator and the R evaporator. The temperature equilibrium angle of the rotary blade is inferred by the fuzzy inference to discharge cool air into the highest-temperature portion within the refrigerator compartment, and the cool air discharging cycle is controlled by the compressor and the R ventilation fan, thereby evenly maintaining the temperature within the refrigeration compartment.

What is claimed is:

1. A temperature controlling method for a separate cooling refrigerator having a rotary blade in which a freezer compartment and a refrigeration compartment having the rotary blade at the rear thereof are separately cooled by installing an evaporator and a ventilation fan in each compartment, said method comprising the steps of:

(a) comparing each temperature measured by a temperataure sensor for the freezer compartment and a temperature sensor for the refrigeration compartment to properly distribute cool air into the freezer compartment and the refrigeration compartment;

(b) inferring a temperature equilibrium angle of the rotary blade required for discharging cool air into the highest-temperature portion among a predetermined number of portions within the refrigeration compartment whose temperatures are inferred; and (c) controlling a stationary angle of the rotary blade toward the inferred temperature equilibrium angle.

2. A temperature controlling method as claimed in claim 1, wherein said step (a) is performed by controlling the ratio of the operation time between the evaporator (F evaporator) and ventilation fan (F fan) for the freezer compartment and the evaporator (R evaporator) and ventilation fan (R fan) for the refrigeration compartment, with respect to a periodical operation time of a compressor.

3. A temperataure controlling method as claimed in claim 2, wherein said step (a) comprises the steps of:

(a-1) starting the compressor, the R evaporator and the R fan;

(a-2) starting the F evaporator and the F fan after a predetermined lapse of time from said step (a-1);

(a-3) stopping the R evaporator and the R fan after a predetermined lapse of time from said step (a-2); and (a-4) stopping the F evaporator and the F fan after a predetermined lapse of time from said step (a-3), wherein said steps (a-1) through (a-4) are sequentially repeated to control the stop time of the R evaporator and the start time of the F evaporator, thereby controlling the amount of cool air to be discharged into the freezer compartment and the refrigeration compartment.

4. A temperature controlling method as claimed in claim 1, wherein said step (b) comprises the steps of:

(b-1) making out data of temperature changing rate at a predetermined portions of the refrigeration compartment according to the lapse of time, based on the temperatures measured at each stationary angle of the rotary blade within the refrigeration compartment;

(b-2) calculating a fuzzy model based on the data of temperature changing rate; and (b-3) performing a fuzzy inference according to the fuzzy model with the temperatures measured by temperature sensors attached to a predetermined portions of the walls of the refrigeration compartment to calculate the temperature equilibrium angle of the rotary blade for the temperature equilibrium within the refrigeration compartment.

5. A temperature controlling method as claimed in claim 2, wherein said step (b) comprises the steps of:

(b-1) making out data of temperature changing rate at a predetermined portions of the refrigeration compartment according to the lapse of time, based on the temperatures measured at each stationary angle of the rotary blade within the refrigeration compartment;

(b-2) calculating a fuzzy model based on the data of temperature changing rate; and (b-3) performing a fuzzy inference according to the fuzzy model with the temperatures measured by temperature sensors attached to a predetermined portions of the walls of the refrigeration compartment to calculate the temperature equilibrium angle of the rotary blade for the temperature equilibrium within the refrigeration compartment.

6. A temperature controlling method as claimed in claim 3, wherein said step (b) comprises the steps of:

(b-1) making out data of temperature changing rate at a predetermined portions of the refrigeration compartment according to the lapse of time, based on the temperatures measured at each stationary angle of the rotary blade within the refrigeration compartment;

(b-2) calculating a fuzzy model based on the data of temperature changing rate; and (b-3) performing a fuzzy inference according to the fuzzy model with the temperatures measured by temperature sensors attached to a predetermined portions of the walls of the refrigeration compartment to calculate the temperature equilibrium angle of the rotary blade for the temperature equilibrium within the refrigeration compartment.

7. A temperature controlling method as claimed in claim 4, wherein said step (b-2) comprises the steps of:

(b-2-1) dividing the dat of temperataure changing rate according to a plurality of data area to calculate linear formulas for each data area;

(b-2-2) calculating a value of unbiasedness criterion (UC) with respect to each linear formula;

(b-2-3) comparing the values of UC to select the least value of UC; and (b-2-4) repeatedly performing said steps (b-2-1) through (b-2-3) with respect to the data area having the least value of UC to obtain a data-divided structure having the least value of UC and calculate a linear formula corresponding to a conclusion part of the fuzzy inference based on the data-divided structure having the least value of UC.

8. A temperature controlling method as claimed in claim 7, wherein said step (b-2-2) comprises the steps of:

(b-2-2-1) calculating parameter values representing a fuzzy area of the data-divided structure; and (b-2-2-2) calculating the value of UC based on the parameter values.

9. A temperature controlling method as claimed in claim 8, wherein said step (b-2-2-1) comprises the steps of:

(b-2-2-1-1) determining the number of parameters of the fuzzy area forming the fuzzy structure;

(b-2-2-1-2) fractionating the probabilistic temperature range of the refrigeration compartment by a predetermined number of bits to construct strings;

(b-2-2-1-3) filling the bits of each string, the number of bits corresponding to the number of the parameters, and the remaining string of the string with different binary number to form a plurality of random strings;

(b-2-2-1-4) calculating a correlation coefficient between the random strings and the measured temperatures; and (b-2-2-1-5) taking information of the random string having the greatest correlation coefficient as the value of parameter.

10. A temperataure controlling method as claimed in claim 9, after said step (b-2-2-1-5), further comprising the steps of:

reproducing the upper group corresponding to the upper 10% of random strings having great correlation coefficients, and selecting the lower group corresponding to the lower 10% of random strings having small correlation coefficients;

crossing over the middle group other than the upper and lower groups with the upper group; and calculating a correlation coefficient of only a corrected upper group obtained by adding the random strings obtained by the crossover, having great correlation coefficients, to the upper group.

11. A temperature controlling method as claimed in claim 7, wherein in said step (b-2-4), a linear formula reflecting a weight of each fuzzy area in the data divided structure to the temperature equilibrium within the refrigeration compartment is calculated.

12. A temperature controlling method as claimed in claim 1, wherein in said step (c), the rotary blade is rotated at the equal velocity if the temperatures of the predetermined portions within the refrigeration compartment, inferred in said step (b), are in a predetermined error range.

* * * * *